US008167558B2

(12) United States Patent
Liang

(10) Patent No.: US 8,167,558 B2
(45) Date of Patent: May 1, 2012

(54) MODULAR SERPENTINE COOLING SYSTEMS FOR TURBINE ENGINE COMPONENTS

(75) Inventor: George Liang, Palm City, FL (US)

(73) Assignee: Siemens Energy, Inc., Orlando, FL (US)

( * ) Notice: Subject to any disclaimer, the term of this patent is extended or adjusted under 35 U.S.C. 154(b) by 568 days.

(21) Appl. No.: 12/355,895

(22) Filed: Jan. 19, 2009

(65) Prior Publication Data

US 2010/0183428 A1 Jul. 22, 2010

(51) Int. Cl.
*F01D 5/14* (2006.01)

(52) U.S. Cl. ..... 416/97 A; 416/97 R; 415/115

(58) Field of Classification Search ..... 415/115; 416/97 R, 97 A
See application file for complete search history.

(56) References Cited

U.S. PATENT DOCUMENTS

| | | | | |
|---|---|---|---|---|
| 1,366,704 | A | 1/1921 | Franklin | |
| 4,753,575 | A | 6/1988 | Levengood et al. | |
| 4,767,268 | A | 8/1988 | Auxier et al. | |
| 5,387,085 | A | 2/1995 | Thomas, Jr, et al. | |
| 5,484,258 | A | 1/1996 | Isburgh et al. | |
| 5,536,143 | A | 7/1996 | Jacala et al. | |
| 5,538,394 | A | 7/1996 | Inomata et al. | |
| 5,667,359 | A | 9/1997 | Huber et al. | |
| 5,695,321 | A * | 12/1997 | Kercher | 416/97 R |
| 5,702,232 | A | 12/1997 | Moore | |
| 5,967,752 | A | 10/1999 | Lee et al. | |
| 5,971,708 | A | 10/1999 | Lee | |
| 6,099,251 | A | 8/2000 | LaFleur | |
| 6,099,252 | A | 8/2000 | Manning et al. | |
| 6,126,396 | A | 10/2000 | Doughty et al. | |
| 6,132,174 | A * | 10/2000 | Staub et al. | 416/96 R |
| 6,174,133 | B1 | 1/2001 | Bunker | |
| 6,174,134 | B1 * | 1/2001 | Lee et al. | 416/97 R |
| 6,220,817 | B1 | 4/2001 | Durgin et al. | |
| 6,247,896 | B1 * | 6/2001 | Auxier et al. | 416/97 R |
| 6,264,428 | B1 | 7/2001 | Dailey et al. | |
| 6,331,098 | B1 * | 12/2001 | Lee | 416/97 R |
| 6,517,312 | B1 | 2/2003 | Jones et al. | |
| 6,533,547 | B2 | 3/2003 | Anding et al. | |
| 6,705,831 | B2 * | 3/2004 | Draper | 415/115 |
| 6,705,836 | B2 | 3/2004 | Bourriaud et al. | |
| 6,832,889 | B1 | 12/2004 | Lee et al. | |
| 6,902,372 | B2 | 6/2005 | Liang | |
| 6,916,150 | B2 | 7/2005 | Liang | |
| 6,932,573 | B2 | 8/2005 | Liang | |

(Continued)

FOREIGN PATENT DOCUMENTS

EP 1065343 A2 1/2001

(Continued)

*Primary Examiner* — Matthew Landau
*Assistant Examiner* — Joseph C Nicely

(57) ABSTRACT

A cooling system for use in a turbine engine component exposed to high temperatures during engine operation. The system includes a serpentine flow passage and an exhaust region. The serpentine flow passage includes a coolant supply inlet. The passage can be configured so that neighboring portions of the passage have coolant flowing in the same direction or, alternatively, in opposite directions. A number of flow disrupting structures, such as microfins and trip strips, can be located along the flow passage. The exhaust region can discharge coolant from the system at reduced exit momentum. The exiting flow can provide film cooling to the component. The cooling system can be provided in a small modular form, which can increase cooling design flexibility and can allow cooling designs tailored to the unique cooling requirements of the individual component. As a result, the modules can result in high levels of cooling effectiveness.

17 Claims, 5 Drawing Sheets

U.S. PATENT DOCUMENTS

| | | | | |
|---|---|---|---|---|
| 6,981,840 | B2 | 1/2006 | Lee et al. | |
| 6,981,846 | B2 | 1/2006 | Liang | |
| 7,029,235 | B2 | 4/2006 | Liang | |
| 7,033,136 | B2 | 4/2006 | Botrel et al. | |
| 7,137,776 | B2 * | 11/2006 | Draper et al. | 415/115 |
| 7,296,972 | B2 * | 11/2007 | Liang | 416/97 R |
| 7,347,671 | B2 * | 3/2008 | Dorling et al. | 416/97 R |
| 7,695,246 | B2 * | 4/2010 | Cunha et al. | 416/97 R |
| 7,699,583 | B2 * | 4/2010 | Cunha | 416/97 R |
| 7,717,675 | B1 * | 5/2010 | Liang | 416/95 |
| 7,806,659 | B1 * | 10/2010 | Liang | 416/97 R |
| 7,988,418 | B2 * | 8/2011 | Cunha et al. | 416/96 R |
| 2002/0119047 | A1 * | 8/2002 | Starkweather | 416/97 R |
| 2003/0044278 | A1 | 3/2003 | Eneau et al. | |
| 2003/0133795 | A1 * | 7/2003 | Manning et al. | 416/97 R |
| 2004/0076519 | A1 | 4/2004 | Halfmann et al. | |
| 2004/0115053 | A1 * | 6/2004 | Shi et al. | 416/97 R |
| 2004/0219017 | A1 * | 11/2004 | Liang | 416/97 R |
| 2005/0008487 | A1 | 1/2005 | Lee et al. | |
| 2005/0031445 | A1 | 2/2005 | McClelland | |
| 2005/0111976 | A1 | 5/2005 | Lee | |
| 2005/0111979 | A1 | 5/2005 | Liang | |
| 2005/0129508 | A1 | 6/2005 | Fried et al. | |
| 2005/0169752 | A1 | 8/2005 | Lee et al. | |
| 2005/0226726 | A1 | 10/2005 | Lee et al. | |
| 2005/0265837 | A1 | 12/2005 | Liang | |
| 2006/0002788 | A1 * | 1/2006 | Liang | 415/115 |
| 2006/0210390 | A1 * | 9/2006 | Draper et al. | 415/115 |
| 2006/0275119 | A1 * | 12/2006 | Liang | 416/97 R |
| 2007/0172355 | A1 * | 7/2007 | Cunha et al. | 416/97 R |
| 2007/0177976 | A1 * | 8/2007 | Cunha et al. | 416/97 R |
| 2009/0060715 | A1 * | 3/2009 | Kopmels | 415/115 |
| 2009/0317234 | A1 * | 12/2009 | Zausner et al. | 415/115 |
| 2010/0158669 | A1 * | 6/2010 | Cunha et al. | 415/115 |

FOREIGN PATENT DOCUMENTS

| | | | |
|---|---|---|---|
| JP | 2003322003 | A | 11/2003 |

* cited by examiner

MODULAR SERPENTINE COOLING SYSTEMS FOR TURBINE ENGINE COMPONENTS

FIELD OF THE INVENTION

This invention is directed generally to turbine engines, and, more particularly, to cooling systems for turbine engine components.

BACKGROUND OF THE INVENTION

Typically, gas turbine engines include a compressor for compressing air, a combustor for mixing the compressed air with fuel and igniting the mixture, and a turbine assembly for producing power. Combustors often operate at high temperatures, which can exceed 2,500 degrees Fahrenheit. Various components in the combustor and the turbine assembly are exposed to these high temperatures. As a result, such components must be made of materials capable of withstanding such high temperatures. Alternatively or in addition, such components can have cooling systems and features to enable the component to survive in an environment which exceeds the capability of the material. While there are numerous cooling configurations in the art, there is a continuing need for improved cooling systems for turbine engine components.

SUMMARY OF THE INVENTION

Aspects of the invention are directed to a cooling system for a turbine engine component having an outer wall and an inner wall. The system also includes a cooling module located between the outer wall and the inner wall.

The cooling module has a serpentine coolant flow passage defined by the outer wall, the inner wall and at least one wall extending from the inner wall to the outer wall. In one cooling module, the flow passage is configured such that coolant flow in one portion of the flow passage is in the same direction as coolant flow in a neighboring portion of the flow passage. The neighboring portions of the flow passage can be substantially parallel to each other. In one embodiment, the flow passage can have a generally rectangular spiral conformation. Coolant can be introduced to the flow passage through a coolant supply inlet. The coolant supply inlet can be centrally located within the module.

In another cooling module, the flow passage is configured such that coolant flow in one portion of the flow passage is in the opposite direction as coolant flow in a neighboring portion of the flow passage. The neighboring portions of the flow passage can be substantially parallel to each other. In one embodiment, a coolant supply inlet that is located at an outer end of the module.

A plurality of microfins are distributed along the flow passage. The microfins extend from the outer wall to the inner wall. The plurality of microfins can be aligned in a row along at least a portion of the flow passage. In addition, a plurality of trip strips can be distributed along the flow passage. The trip strips can extend from the inner wall and/or the outer wall. The trip strips can be arranged so as to define a generally v-shaped configuration along at least a portion of the flow passage. For instance, one or more pairs of trip strips can be arranged in a generally v-shaped configuration. The trip strips can disrupt laminar flow along the flow passage. In one embodiment, the plurality of microfins can be distributed along a central region of the flow passage. In such case, a first plurality of trip strips can be positioned on a first side of the microfins, and a second plurality of trip strips can be positioned on an opposite side of the microfins.

The cooling system can further include an exhaust diffusion region. The exhaust diffusion region and the flow passage can be separated by a wall. One or more metering holes can be provided in the wall such that the exhaust diffusion region and the flow passage are in fluid communication. The exhaust diffusion region can include a transverse rib positioned such that coolant exiting the at least one metering hole impinges on the transverse rib. The exhaust diffusion region can include an exhaust diffuser passage permitting fluid communication with the exterior environment of the component. Thus, coolant can be discharged from the cooling system through the exhaust diffuser passage so as to film cool an outermost surface of the component.

Another cooling system according to aspects of the invention includes a turbine engine component having an outer wall and an inner wall. A plurality of cooling modules are located between the outer wall and the inner wall. In one embodiment, at least some of the plurality of cooling modules are provided in an aligned arrangement. In another embodiment, at least some of the plurality of cooling modules are provided in a staggered arrangement.

Each of the plurality of cooling modules has a serpentine coolant flow passage defined by the outer wall, the inner wall and at least one wall extending from the inner wall to the outer wall. A plurality of microfins are distributed along the flow passage. The microfins extend from the outer wall to the inner wall. A plurality of trip strips are distributed along the flow passage. The trip strips can disrupt laminar flow along the flow passage. The trip strips can extend from the inner wall and/or the outer wall.

Each cooling module further includes an exhaust diffusion region. The exhaust diffusion region and the flow passage are separated by a wall. One or more metering holes are provided in the wall such that the exhaust diffusion region and the flow passage are in fluid communication. The exhaust diffusion region includes an exhaust diffuser passage, which permitting fluid communication with an exterior of the component, including the exterior environment of the component. Thus, coolant can be discharged from the cooling system through the exhaust diffuser passage so as to film cool an outermost surface of the component.

DETAILED DESCRIPTION OF EMBODIMENTS OF THE INVENTION

Figure 1:
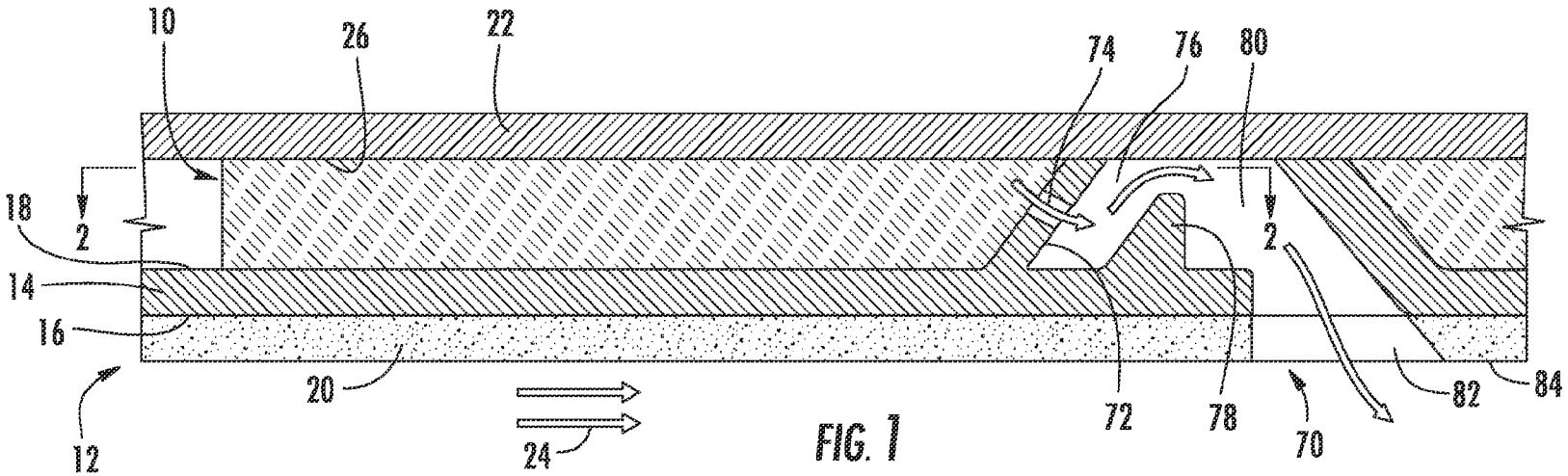
FIG. 1 is a side elevation cross-sectional view of a cooling system according to aspects of the invention.

A system according to aspects of the present invention can provide cooling and other benefits to various turbine engine components. This detailed description is intended only as exemplary. Embodiments of the invention are shown in FIGS.

1-5, but aspects of the invention are not limited to the illustrated structure or application.

A cooling system 10 according to aspects of the invention can be used in connection with a turbine engine component 12 that must be cooled during engine operation. For instance, the component 12 can be a liner, a turbine blade or a turbine vane, just to name a few possibilities. The component 12 can have an outer wall 14 having an outer surface 16 and an inner surface 18. At least a portion of the outer surface 16 can be coated with a thermal barrier coating 20. The component 12 can further include an inner wall 22 or backing plate. The terms "inner" and "outer" are intended to indicate the relative proximity of such items to the hot gas flow 24 to which the component 12 is exposed.

Within the component 12, there can be a cooling system 10 configured in accordance with aspects of the invention. The cooling system 10 can be formed in any suitable manner. For instance, the cooling system 10 can be formed by either casting the cooling geometry within the component 12 to form a near wall cooling. Alternatively, the cooling system 10 can be machined into the outer wall 14. In such case, the inner wall 22 can be attached to the outer wall 14, such as by transient liquid phase (TLP) bonding.

Figure 2:
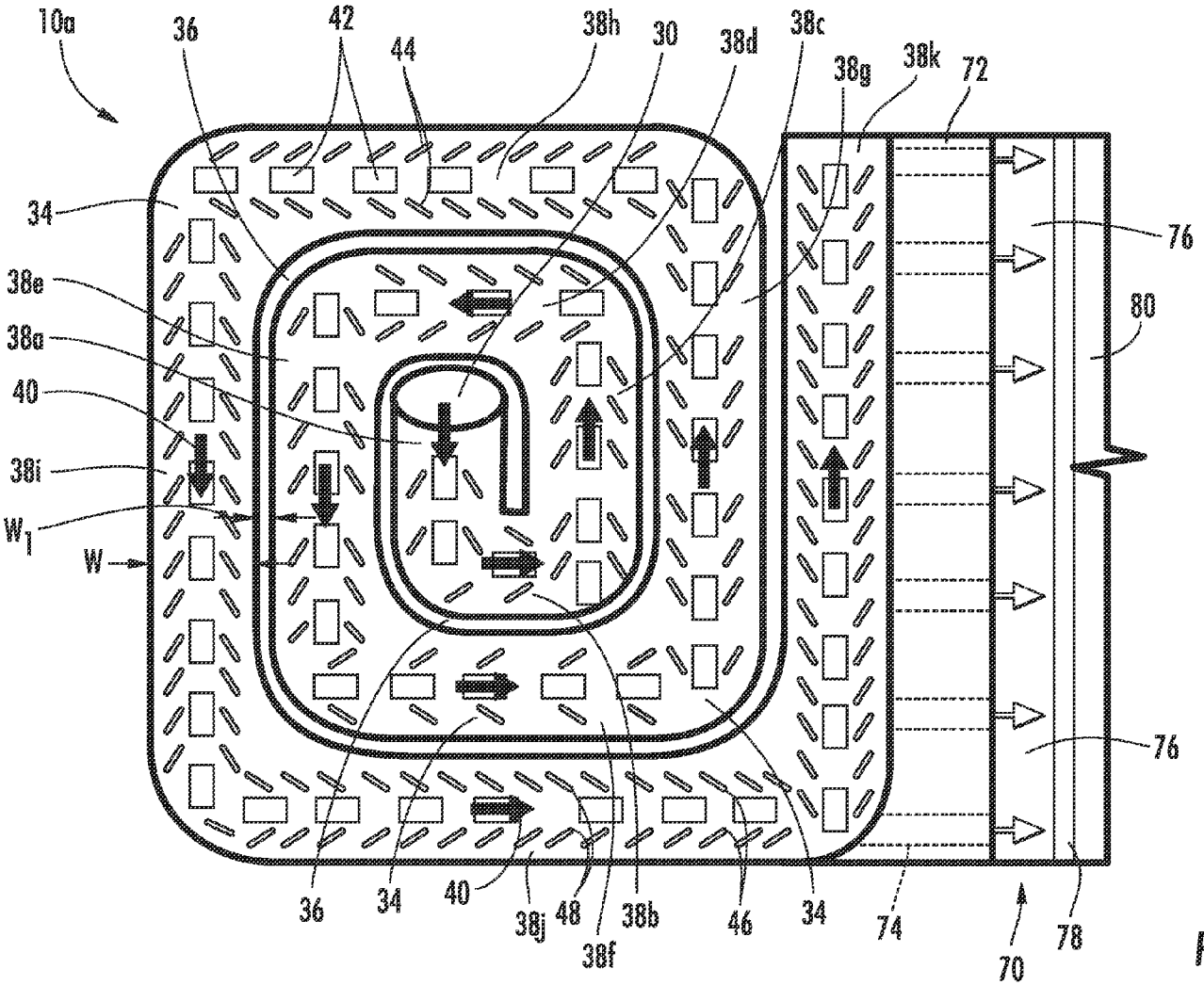
FIG. 2 is a top plan cross-sectional view of a first cooling system according to aspects of the invention, taken along line 2-2 in FIG. 1.

A first cooling module 10*a* according to aspects of the invention is shown in FIG. 2. The first cooling module 10*a* can have a coolant supply inlet 30. The coolant supply inlet 30 can deliver a coolant to the first cooling module 10*a*. The coolant can come from any suitable source. Further, the coolant can be any suitable coolant, such as air. The inlet 30 can be centrally located in the module 10*a*.

The coolant can flow along a serpentine flow passage 34, which can be defined by the inner wall 22, the outer wall 14, and one or more walls 36 extending therebetween. The serpentine flow passage 34 can have a plurality of segments 38*a*, 38*b*, 38*c*, 38*d*, 38*e*, 38*f*, 38*g*, 38*h*, 38*i*, 38*k*. As shown in FIG. 2, the flow passage 34 can have a generally a rectangular spiral conformation, which is just one of many possible configurations. Coolant can flow spirally outward from the inlet 30. Arrows are shown to represent the general direction of coolant flow 40 along the flow passage 34.

The flow passage 34 can wind so that the coolant flow in one portion of the flow passage 34 is in the same direction as a neighboring or adjacent portion of the flow passage 34, as is shown in FIG. 2. For instance, the coolant flow 40 can be in the same direction in neighboring portions of the flow passage 34, such as in segments 38*a*, 38*e*, 38*i*. Similarly, coolant flow 40 can be in the same direction in neighboring segments 38*b*, 38*f*, 38*j*. Further, coolant flow 40 can be in the same direction in neighboring segments 38*c*, 38*g*, 38. Still further, coolant flow 40 can be in the same direction in neighboring segments 38*d*, 38*h*. The neighboring portions of the flow passage 34, including the various segment groups noted above, can be substantially parallel to each other.

The flow passage 34 can have any suitable width W. In one embodiment, the width W of the flow passage 34 can be substantially identical along the entire length of the flow passage 34. The width W of the flow passage 34 can be greater than the width W1 of the walls 36 that define in part the flow passage 34.

Along the flow passage 34, there can be numerous structures for disturbing the flow. For example, a plurality of microfins 42 can be distributed along the flow passage 34 in any suitable manner. For example, the microfins 42 can be generally equally spaced along the flow passage 34. The microfins 42 can be arranged in a single row (as shown in FIG. 2) or in a plurality of rows (not shown). The microfins 42 can be arranged so that they are aligned with the direction of coolant flow, as shown in FIG. 2. Alternatively, one or more of the microfins 42 can be arranged so as to be at least partially transverse to the direction of coolant flow. The microfins 42 can be generally centrally located in the flow passage 34.

The microfins 42 can have any suitable configuration. In one embodiment, the microfins 42 can have a substantially rectangular cross-sectional shape. Alternatively or in addition, the microfins 42 can have a substantially airfoil-shaped cross-section. The plurality of microfins 42 can be identical to each other, or at least one of the microfins 42 can be different from the other microfins 42 in one or more respects. The microfins 42 can extend from the outer wall 14 to the inner wall 22.

The first cooling module 10*a* can include additional structures for disturbing the flow along the flow passage 34. For instance, there can be a plurality of trip strips 44. The trip strips 44 can disrupt laminar coolant flow along the flow passage 34 and to improve the heat transfer cooling capability of the module 10*a*.

The trip strips 44 can be distributed along the flow passage 34 in any suitable manner. For example, the trip strips 44 can be generally equally spaced along the flow passage 34. In one embodiment, the trip strips 44 can be arranged on each side of the plurality of microfins 42. In one embodiment, the trip strips 44 on opposite sides of the microfins 42 can be in a generally v-shaped configuration, as shown in FIG. 2. In such case, an inner end 46 of each trip strip 44 can be located at substantially the midpoint along the length of each microfin 42, as shown in FIG. 2. Alternatively or in addition, the inner ends 48 of another pair of trip strips 44 can be located within the space 50 between each pair of microfins 42. Use of the modifier "inner" with ends 46, 48 is intended to mean relative to the center of the flow passage 34. Each trip strip 44 can be oriented at any suitable angle along the flow passage 34.

The arrangement of the trip strips 44 can be substantially constant along the flow passage 34. Alternatively, the arrangement of the trip strips 44 can change on each segment 38*a*, 38*b*, 38*c*, 38*d*, 38*e*, 38*f*, 38*g*, 38*h*, 38*i*, 38*j*, 38*k* of the flow passage 34. In one embodiment, the trip strips 44 can alternate between two different arrangements of the trip strips 44. For instance, a first portion of the flow passage 34 could have a first arrangement of the trip strips 44, a second portion of the flow passage 34 could have a second arrangement of the trip strips 44, a third portion of the flow passage 34 could have the first arrangement of trip strips 44, a fourth portion of the flow passage 34 could have the second arrangement of trip strips 44, and so forth. In the case of the v-shaped configuration, flow passage segment 38*h* can have trip strips 44 oriented with the "open" or wide end of the v-shaped configuration facing the oncoming flow, and flow passage segment 38*i* can have trip strips 55 oriented with the "open" or wide end of the v-shaped configuration facing away from the oncoming flow, as is shown in FIG. 2.

The trip strips 44 can protrude from the inner surface 18 of the outer wall 14 and/or a surface 26 of the inner wall 22. The trip strips 44 do not extend the entire distance between the outer wall 14 and the inner wall 22. Rather, the trip strips 44 can protrude a minimal distance from the surface on which they are provided. In one embodiment, the trip strips 44 can extend less than about one quarter of the distance between the outer wall 14 and the inner wall 22. Alternatively, the trip strips 44 can extend less than about one eighth of the distance between the outer wall 14 and the inner wall 22.

In operation, cooling air can be supplied through the supply inlet 30, which can be provided in the inner wall 22 of the first cooling module 10*a*. The cooling air can impinge onto the inner surface 18 of the hot outer wall 14. The cooling air can then flow along the serpentine flow passage 34, such as in the parallel flow configuration shown in FIG. 2. This parallel flow configuration can provide convective cooling of the outer wall 14. Coolant can be exhausted from the module 10*a* in any suitable manner and one example will be described later. It should also be noted that the first cooling module 10*a* can be relatively small. In one embodiment, the first cooling module 10*a* can be on the scale of about one inch square and smaller. Thus, it can be used to provide cooling to a localized portion of the outer wall 14. The first cooling module 10*a* can be used alone or in combination with other cooling modules to provided tailored cooling for a particular location.

Figure 3:
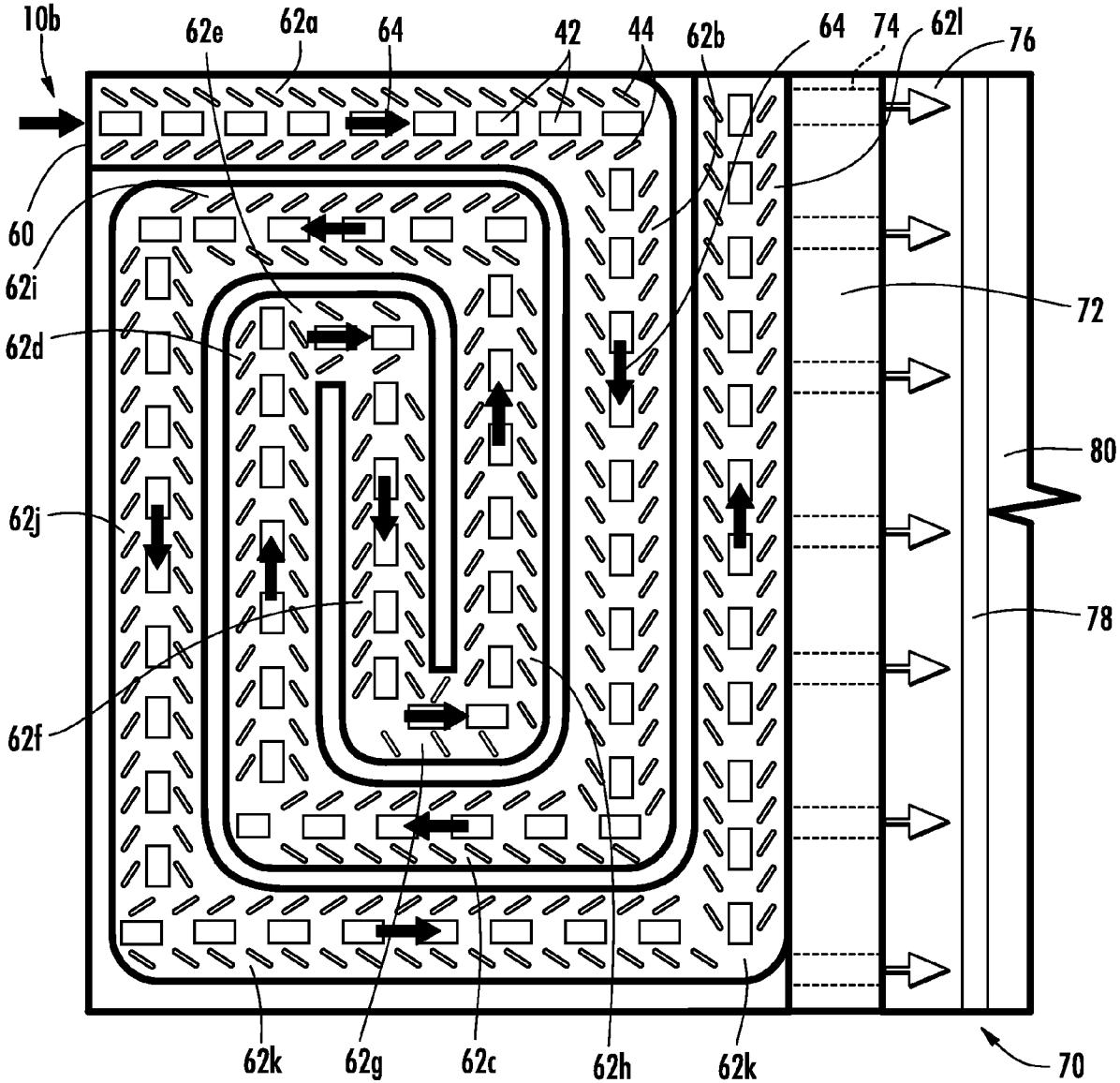
FIG. 3 is a top plan cross-sectional view of a second cooling system according to aspects of the invention.

A second cooling module 10*b* according to aspects of the invention is shown in FIG. 3. The second cooling module 10*b* can include a number of same features as the first cooling module 10*a*, such as a plurality of microfins 44 and a plurality of trip strips 46. The above description of such structures and other features of the first cooling module 10*a* apply equally to the second cooling module 10*b*. Therefore, where appropriate, FIG. 3 uses identical reference numbers to those used in connection with FIG. 2. Notable features of difference will be described below.

The second cooling module 10*b* can include coolant supply inlet that is located at one end or corner of the module 10*b*. The coolant can flow along a serpentine flow passage 62. The serpentine flow passage 62 can have a plurality of segments 62*a*, 62*b*, 62*c*, 62*d*, 62*e*, 62*f*, 62*g*, 62*h*, 62*i*, 62*j*, 62*k*, 62*l*. As shown in FIG. 3, the flow passage 34 can have a generally a rectangular conformation, which is just one of many possible configurations.

From the inlet 60, coolant can flow toward the center of the module 10*b*. Arrows are shows to represent the general direction of coolant flow 64 along the passage 62. The flow passage 62 can be arranged so that the coolant flow in one portion of the flow passage 62 will be in the opposite direction of coolant flow in a neighboring or adjacent portion of the flow passage 62, as shown in FIG. 3. For instance, the coolant flow 64 can be in opposite directions in neighboring parallel flow passage segments 62*a*, 62*c*. Similarly, coolant flow 64 can be in opposite directions in the following pairs of neighboring segments: 62*b* and 62*h*; 62*b* and 62*l*; 62*c* and 62*g*; 62*c* and 62*k*; 62*d* and 62*j*; 62*d* and 62*f*; 62*e* and 62*i*; and 62*f* and 62*h*. The neighboring portions of the flow passage 62, including the various segment groups noted above, can be substantially parallel to each other.

In operation, cooling air can be supplied through the supply inlet 60, which can be provided in the inner wall 22 of the second cooling module 10*b*. The cooling air can impinge onto the inner surface 18 of the hot outer wall 14. The cooling air can then flow along the serpentine flow passage 62, such as in a counter flow configuration of FIG. 3. This counter flow configuration can provide convective cooling of the outer wall 14 and can achieve a high level of internal cooling effectiveness. Coolant can be exhausted from the module 10*b* in any suitable manner and one example will be described later.

It should also be noted that the second cooling module 10*b* can be relatively small. For example, the second cooling module 10*b* can be on the scale of about one inch square or less. Thus, the second cooling module 10*b* can be used to provide cooling to a localized portion of the wall. Thus, the second cooling module 10*b* can be used with other cooling modules, such as the first cooling module 10*a*, to provided tailored cooling flow for a particular location in the component 12.

Each of the above cooling modules 10*a*, 10*b* can exhaust coolant through an exhaust region 70 (FIG. 1). The exhaust region 70 can be separated from the flow passage 34, 62 by wall 72. The wall 72 can be angled relative to the outer wall 14 of the component 12. There can be any suitable angle between the wall 72 and the outer wall 14. In one embodiment, the wall 72 can be oriented at less than 90 degrees relative to the outer wall 14. One or more metering holes 74 can be provided in the wall 72 to permit fluid communication between an end segment (38*k* or 62*l*) of the serpentine flow passage 34, 62 and a first chamber 76 of the exhaust region 70. The metering holes 74 can have any suitable size, shape and distribution. In one embodiment, there can be a plurality of circular metering holes 74 that are substantially equally spaced and extend substantially parallel through the wall 72.

In the first chamber 76, the flow can impinge on a transverse rib 78. The flow can be diffused substantially uniformly in the first chamber 76. The flow is then forced to go around the rib 78. The flow can enter a second chamber 80 from which it is discharged from the component 12 at reduced exit momentum. The flow can exit through an exhaust diffuser passage 82 formed in the outer wall 14 and in any coating, such as a thermal barrier coating 20, on the outer wall 14. The exhaust diffuser passage 82 can be in the form of a slot. The cross-sectional area of the exhaust passage 82 can increase from the second chamber 80 to the outermost surface 84 of the component 12. The outermost surface 84 can be defined by the outer surface 16 of the outer wall 14 and/or the outer surface of any coating applied on the surface. The exiting flow can enter the hot gas flow 24 and can provide film cooling to the component 12.

The configuration of the exhaust region 70 minimize coolant penetration into the hot gas path 24. The configuration of the exhaust region 70 according to aspects of the invention can result in build up of the coolant in the sub-boundary layer next to the outermost surface 84. As a result, better film coverage in the direction of flow and in the circumferential direction can be achieved.

Figure 4:
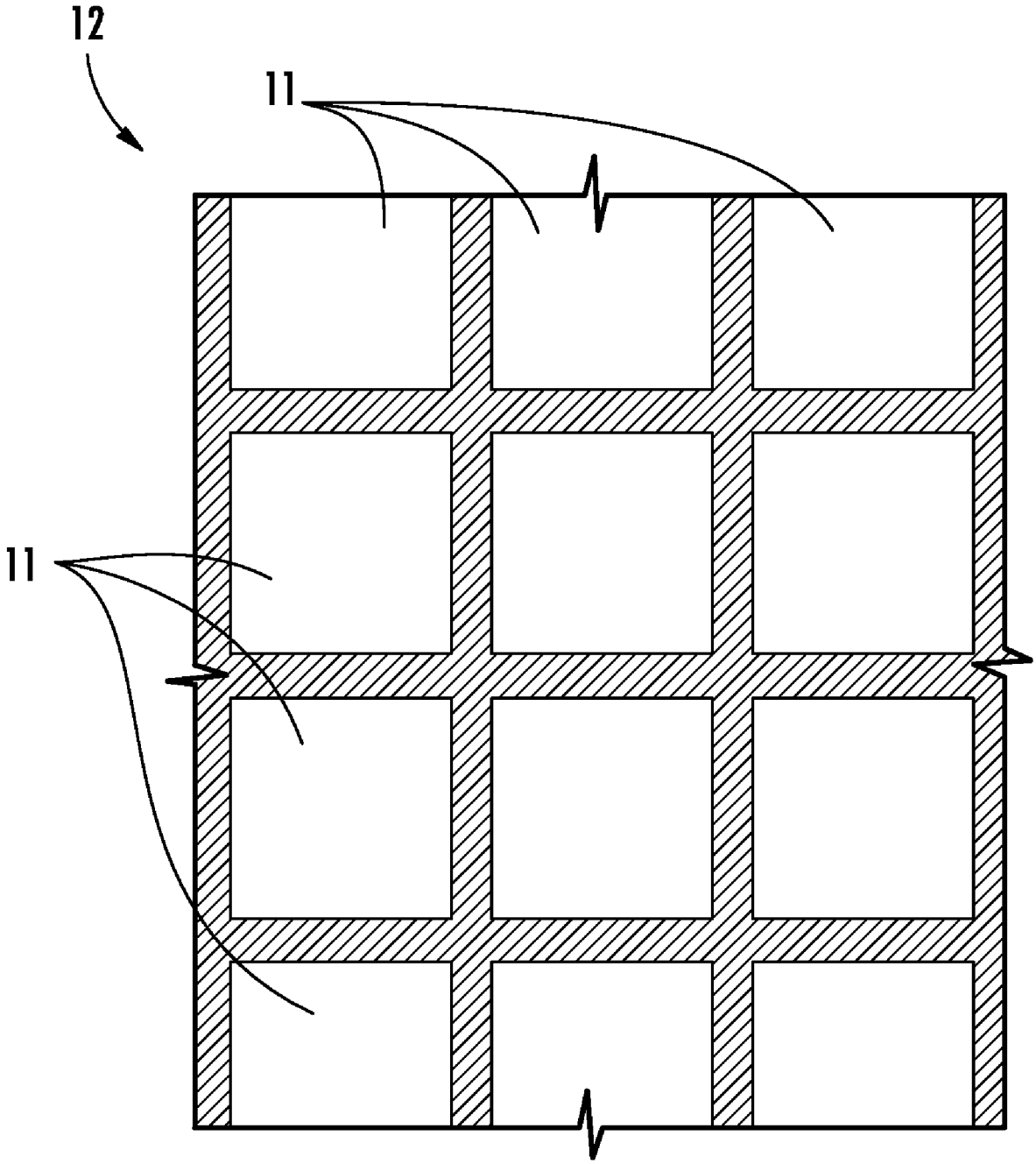
FIG. 4 is a top plan partial cross-sectional view of one arrangement of a plurality of cooling modules according to aspects of the invention, showing aligned cooling modules.
Figure 5:
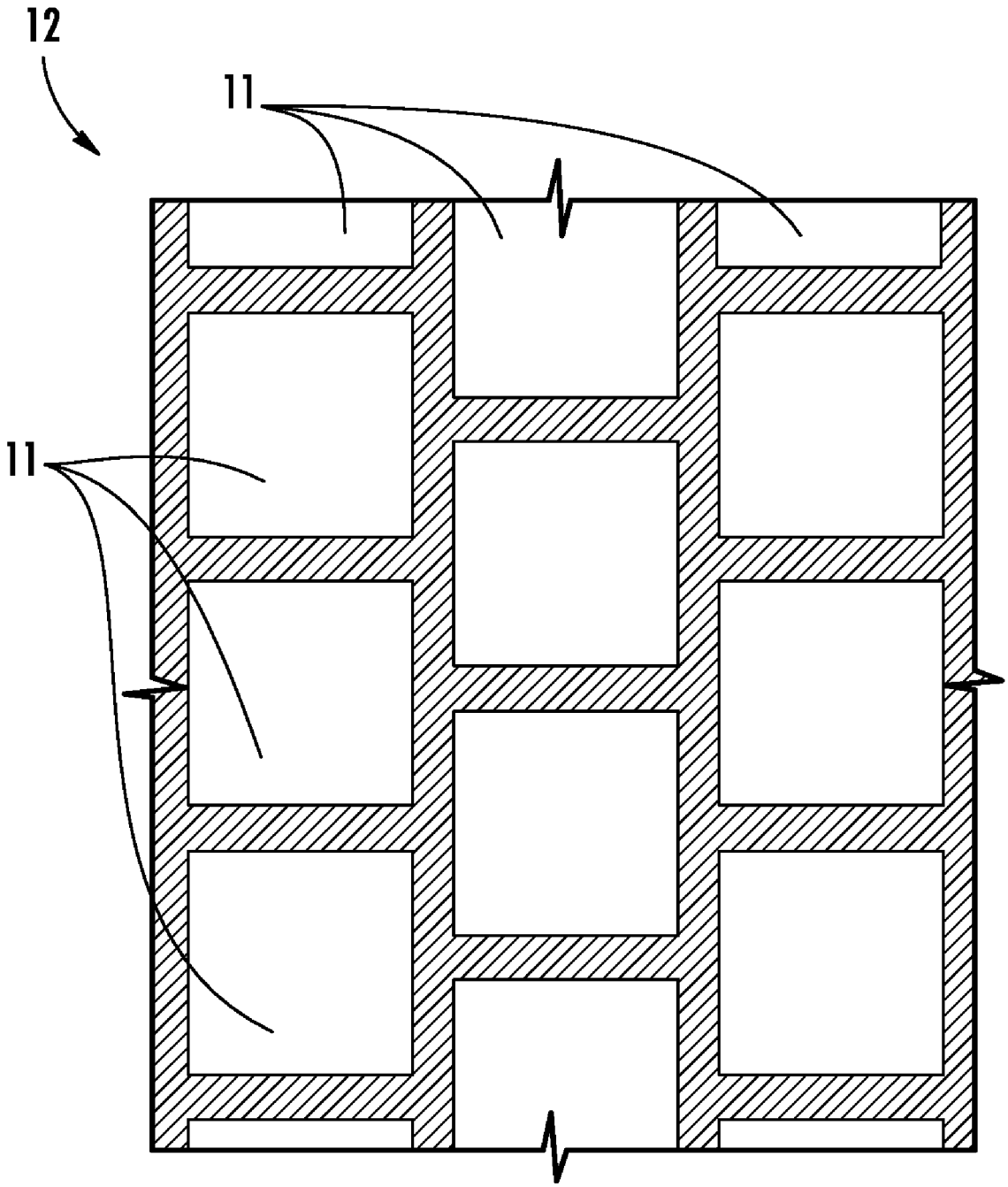
FIG. 5 is a top plan partial cross-sectional view of another arrangement of a plurality of cooling modules according to aspects of the invention, showing staggered cooling modules.

According to aspects of the invention, a plurality of cooling modules 11 can be provided to cool the component 12 (see FIGS. 4 and 5). Any suitable quantity of modules 11 can be used. The cooling modules 11 can be arranged in any suitable manner. For instance, FIG. 4 shows an arrangement in which the plurality of cooling modules 11 are substantially aligned in rows in one or more directions. Alternatively, FIG. 5 shows an arrangement in which the plurality of cooling modules 11 are arranged in a staggered configuration. The staggered configuration can help improve the film cooling effectiveness of the coolant exiting the modules 11. Alternatively, combinations of these and/or other arrangements can be used.

It should be noted that when a plurality of modules are provided, the modules 11 can all be identical to each other or at least one of the modules 11 can be different. The modules 11 can be any suitable module, including the first cooling module 10*a* and the second cooling module 10*b*.

It will be appreciated that a cooling module having the combination of a finned serpentine cooling passage and a diffusion exhaust region according to aspects of the invention can create a high level of cooling effectiveness for a component exposed to a hot operational environment. As a result, more uniform wall temperature for the component can be achieved.

Further, the double metering formation of the cooling modules—metering by a single coolant supply inlet 30, 60 and metering by holes 74 in the wall 72—can result in better cooling flow control. In addition, the modular nature of the cooling modules also allow cooling designs to be tailored to a local external heat load and pressure profile. Further, the small compartmentalized formation of the modules increases cooling design flexibility. Further, the risk of component failure is minimized if one of the cooling modules fails, as such failure will not affect the performance of the other cooling modules. With such a cooling construction approach, optimal usage of cooling air can be achieved.

As noted above, a thermal barrier coating can be applied onto external surfaces of a component exposed to hot gases during engine operation. In many prior systems, cooling exhaust holes are relatively small so care must be taken not to overcoat any cooling exhaust holes with the thermal barrier coating. However, the exhaust region 70 of the cooling modules 10*a*, 10*b* according to aspects of the invention have a relatively large exhaust diffuser passage 82. As a result, the passage 82 is sufficiently large such that inadvertent overspread of a thermal barrier coating onto the passage 82 may not substantially impact the performance of the passage 82. Thus, during refurbishment of the component, the thermal barrier coating can be removed and reapplied without the need for film cooling hole masking, which can result in appreciable time and labor savings.

The foregoing description is provided in the context of two possible cooling modules according to aspects of the invention. It will of course be understood that the invention is not limited to the specific details described herein, which are given by way of example only, and that various modifications and alterations are possible within the scope of the invention as defined in the following claims.

What is claimed is:

1. A cooling system comprising:

a turbine engine component having an outer wall and an inner wall;

a cooling module located between the outer wall and the inner wall, the cooling module having a serpentine coolant flow passage defined by the outer wall, the inner wall and at least one wall extending from the inner wall to the outer wall;

a plurality of microfins distributed along the flow passage, the microfins extending from the outer wall to the inner wall; a plurality of trip strips distributed along the flow passage, whereby the trip strips disrupt laminar flow along the flow passage;

wherein the flow passage is configured such that coolant flow in one portion of the flow passage is in the same direction as coolant flow in a neighboring portion of the flow passage; and an exhaust diffusion region positioned downstream of the serpentine coolant flow passage, wherein the exhaust diffusion region and the serpentine coolant flow passage are separated by a wall extending between the inner and outer walls, wherein at least one metering hole extends through the wall such that the exhaust diffusion region and the serpentine coolant flow passage are in fluid communication and wherein the wall separating the exhaust diffusion region and the serpentine coolant flow passage is positioned at an acute angle relative to the inner and outer walls.

2. The cooling system of claim 1 further including a coolant supply inlet that is centrally located within the module, whereby coolant is introduced to the flow passage through the coolant supply inlet.

3. The cooling system of claim 1 wherein the flow passage has a generally rectangular spiral conformation.

4. The cooling system of claim 1 wherein the plurality of microfins are distributed along a central region of the flow passage.

5. The cooling system of claim 4 wherein a first plurality of trip strips are positioned on a first side of the microfins, and a second plurality of trip strips are positioned on an opposite side of the microfins.

6. The cooling system of claim 5 wherein the first and second plurality of trip strips together form a v-shaped configuration along at least a portion of the flow passage.

7. The cooling system of claim 1 wherein the exhaust diffusion region includes a transverse rib positioned such that coolant exiting the at least one metering hole impinges on the transverse rib.

8. The cooling system of claim 1 wherein the exhaust diffusion region includes an exhaust diffuser passage permitting fluid communication with an exterior of the component, whereby coolant is discharged from the cooling module through the exhaust diffuser passage so as to film cool an outermost surface of the component.

9. The cooling system of claim 1 wherein the exhaust diffusion region is formed from first and second chambers.

10. The cooling system of claim 9 wherein the first and second chambers of the exhaust diffusion region are separated by a rib that contacts only one of the inner and outer walls.

11. The cooling system of claim 10 wherein an inner surface of an upstream side of the rib is aligned with the acute angle of the wall separating the exhaust diffusion region and the serpentine coolant flow passage.

12. A cooling system comprising:

a turbine engine component having an outer wall and an inner wall;

a plurality of cooling modules located between the outer wall and the inner wall, each of the plurality of cooling modules having:

a serpentine coolant flow passage defined by the outer wall, the inner wall and at least one wall extending from the inner wall to the outer wall;

a plurality of microfins distributed along the flow passage, the microfins extending from the outer wall to the inner wall;

a plurality of trip strips distributed along the flow passage, whereby the trip strips disrupt laminar flow along the flow passage;

each cooling module further including an exhaust diffusion region, the exhaust diffusion region and the flow passage being separated by a wall, wherein at least one metering hole is provided in the wall such that the exhaust diffusion region and the flow passage are in fluid communication, the exhaust diffusion region includes an exhaust diffuser passage permitting fluid communication with an exterior of the component, whereby coolant is discharged from the cooling system through the exhaust diffuser passage so as to film cool an outermost surface of the component; and wherein the wall separating the exhaust diffusion region and the serpentine coolant flow passage is positioned at an acute angle relative to the inner and outer walls.

13. The cooling system of claim 12 wherein the plurality of cooling modules are provided in an aligned arrangement.

14. The cooling system of claim 12 wherein the plurality of cooling modules provided in a staggered arrangement.

15. The cooling system of claim 12 wherein the exhaust diffusion region is formed from first and second chambers.

16. The cooling system of claim 15 wherein the first and second chambers of the exhaust diffusion region are separated by a rib that contacts only one of the inner and outer walls.

17. The cooling system of claim 16 wherein an inner surface of an upstream side of the rib is aligned with the acute angle of the wall separating the exhaust diffusion region and the serpentine coolant flow passage.

* * * * *